US007434271B2

(12) United States Patent
Klayman-Grodsky

(10) Patent No.: US 7,434,271 B2
(45) Date of Patent: Oct. 14, 2008

(54) CLOTHING ARTICLE HAVING AN ENTERTAINMENT FEATURE

(76) Inventor: Alisa Klayman-Grodsky, 31 Monterey Ave., Staten Island, NY (US) 10312

( * ) Notice: Subject to any disclaimer, the term of this patent is extended or adjusted under 35 U.S.C. 154(b) by 0 days.

(21) Appl. No.: 11/158,870

(22) Filed: Jun. 21, 2005

(65) Prior Publication Data

US 2005/0278821 A1 Dec. 22, 2005

Related U.S. Application Data

(60) Provisional application No. 60/581,733, filed on Jun. 21, 2004.

(51) Int. Cl.
*A41D 27/08* (2006.01)
*A41D 27/20* (2006.01)

(52) U.S. Cl. ..... 2/244; 2/249

(58) Field of Classification Search ..... 2/49.2, 2/69, 48, 75, 80, 111, 102, 227, 94, 115, 2/244, 245–254; 446/28; 40/586
See application file for complete search history.

(56) References Cited

U.S. PATENT DOCUMENTS 2,593,218 A * 4/1952 Swain ..... 2/48
2,628,452 A * 2/1953 Gladstein ..... 446/28
2,655,762 A * 10/1953 Burke ..... 446/327
D177,692 S * 5/1956 O'Brien ..... D2/616
3,087,277 A * 4/1963 McCook ..... 446/27
3,308,479 A * 3/1967 Sesco, Jr. ..... 2/50
3,447,165 A * 6/1969 Brosk ..... 2/75
3,789,546 A * 2/1974 Morrison ..... 446/327
3,918,180 A * 11/1975 Chamberlin ..... 434/178
4,068,313 A * 1/1978 Goldman ..... 2/49.1
4,138,745 A * 2/1979 Greenspan ..... 2/247
4,266,300 A * 5/1981 Partridge ..... 2/247
4,280,292 A * 7/1981 Hills ..... 40/538
4,304,065 A * 12/1981 Baiera ..... 446/327
4,498,613 A * 2/1985 Donahue et al. ..... 224/251
4,543,669 A * 10/1985 Katz ..... 2/84
4,608,024 A * 8/1986 Skolnick ..... 446/148
4,750,225 A * 6/1988 Simons et al. ..... 5/485
D310,929 S * 10/1990 Blau ..... D6/602
4,967,454 A * 11/1990 Elieff ..... 24/712.1
5,054,127 A * 10/1991 Zevchak ..... 2/247
5,117,507 A * 6/1992 Long ..... 2/158
5,394,565 A * 3/1995 Stewart et al. ..... 2/69
5,421,032 A * 6/1995 Murphy ..... 2/67
5,468,152 A * 11/1995 Lenart ..... 434/429
5,516,321 A * 5/1996 Kornbleuth ..... 446/28
5,542,122 A * 8/1996 Moldovan ..... 2/69
5,561,864 A * 10/1996 DeMars ..... 2/209.13

(Continued)

FOREIGN PATENT DOCUMENTS

GB 2421420 A * 6/2006

(Continued)

*Primary Examiner*—Alissa L Hoey
(74) *Attorney, Agent, or Firm*—Sills, Cummis & Gross P.C

(57) ABSTRACT

A garment or dress having detachable pockets on each side of the front of the garment. The pockets can be used in their normal fashion for retaining objects placed therein by the wearer or can be detached from the garment to be used as hand puppets by the wearer.

17 Claims, 5 Drawing Sheets

U.S. PATENT DOCUMENTS

| | | | | | |
|---|---|---|---|---|---|
| 5,643,037 | A | * | 7/1997 | Altschul | 446/28 |
| 5,713,781 | A | * | 2/1998 | Castanis | 446/369 |
| 5,742,940 | A | * | 4/1998 | Sparks | 2/79 |
| 5,979,085 | A | * | 11/1999 | Ross et al. | 36/136 |
| 6,000,056 | A | * | 12/1999 | Brady et al. | 2/49.1 |
| 6,041,445 | A | * | 3/2000 | Davitt | 2/400 |
| 6,063,457 | A | * | 5/2000 | Anderson | 428/7 |
| 6,079,049 | A | * | 6/2000 | Moir | 2/69 |
| 6,126,507 | A | * | 10/2000 | Lieberman | 446/327 |
| 6,233,747 | B1 | * | 5/2001 | Barker | 2/247 |
| 6,233,763 | B1 | * | 5/2001 | Spaan | 5/485 |
| 6,276,074 | B1 | * | 8/2001 | Martin | 36/100 |
| 6,279,167 | B1 | * | 8/2001 | Johnson et al. | 2/209.13 |
| 6,769,139 | B1 | * | 8/2004 | Goldkind | 2/247 |
| 6,966,472 | B2 | * | 11/2005 | Szarek | 224/607 |
| D512,752 | S | * | 12/2005 | Stainbrook et al. | D21/588 |
| 7,003,810 | B2 | * | 2/2006 | Goldkind | 2/227 |
| 2002/0020019 | A1 | * | 2/2002 | Koenig | 5/636 |
| 2002/0124297 | A1 | * | 9/2002 | Caris et al. | 2/313 |
| 2004/0221372 | A1 | * | 11/2004 | Zborovsky-Fenster | 2/250 |
| 2005/0208870 | A1 | * | 9/2005 | Collard et al. | 446/327 |

FOREIGN PATENT DOCUMENTS

| | | | |
|---|---|---|---|
| WO | WO2007015037 | * | 2/2007 |

* cited by examiner

CLOTHING ARTICLE HAVING AN ENTERTAINMENT FEATURE

RELATED APPLICATIONS

The present application claims priority to Provisional Patent Application Ser. No. 60/581,733, filed on Jun. 21, 2004 and which is incorporated herein in its entirety.

FIELD OF THE INVENTION

The present invention is directed to clothing, particularly children's clothing having an entertainment feature as a part thereof. More specifically, the invention is directed to an article of clothing for a small child or toddler having pockets which are also detachable hand puppets for the child to play with.

BACKGROUND OF THE INVENTION

Most parents of small children know how difficult a long car ride, train ride or flight can be with one or more small children. Small children are easily bored and when bored they often become unruly. Parents attempt to curtail this by trying to keep the children occupied for as much of the duration of the trip as possible. Parents often bring books for the children to look at, coloring books for the children to draw in, as well as toys to play with.

Additional ways for parents to keep children occupied and allow children to entertain themselves are always welcome. The present invention provides an additional way for children to keep themselves occupied and enjoy themselves.

SUMMARY OF THE INVENTION

The invention comprises a pull-over type or wrap-around garment or dress to be worn by a child and having pockets on each side of the front of the garment. The pockets can be used in their normal fashion for retaining objects placed therein by the child. Additionally, the pockets may be detachable from the garment, such as via hook and loop type fasteners such as Velcro®.

DESCRIPTION OF THE DRAWING FIGURE

DETAILED DESCRIPTION OF THE INVENTION

Figure 1:
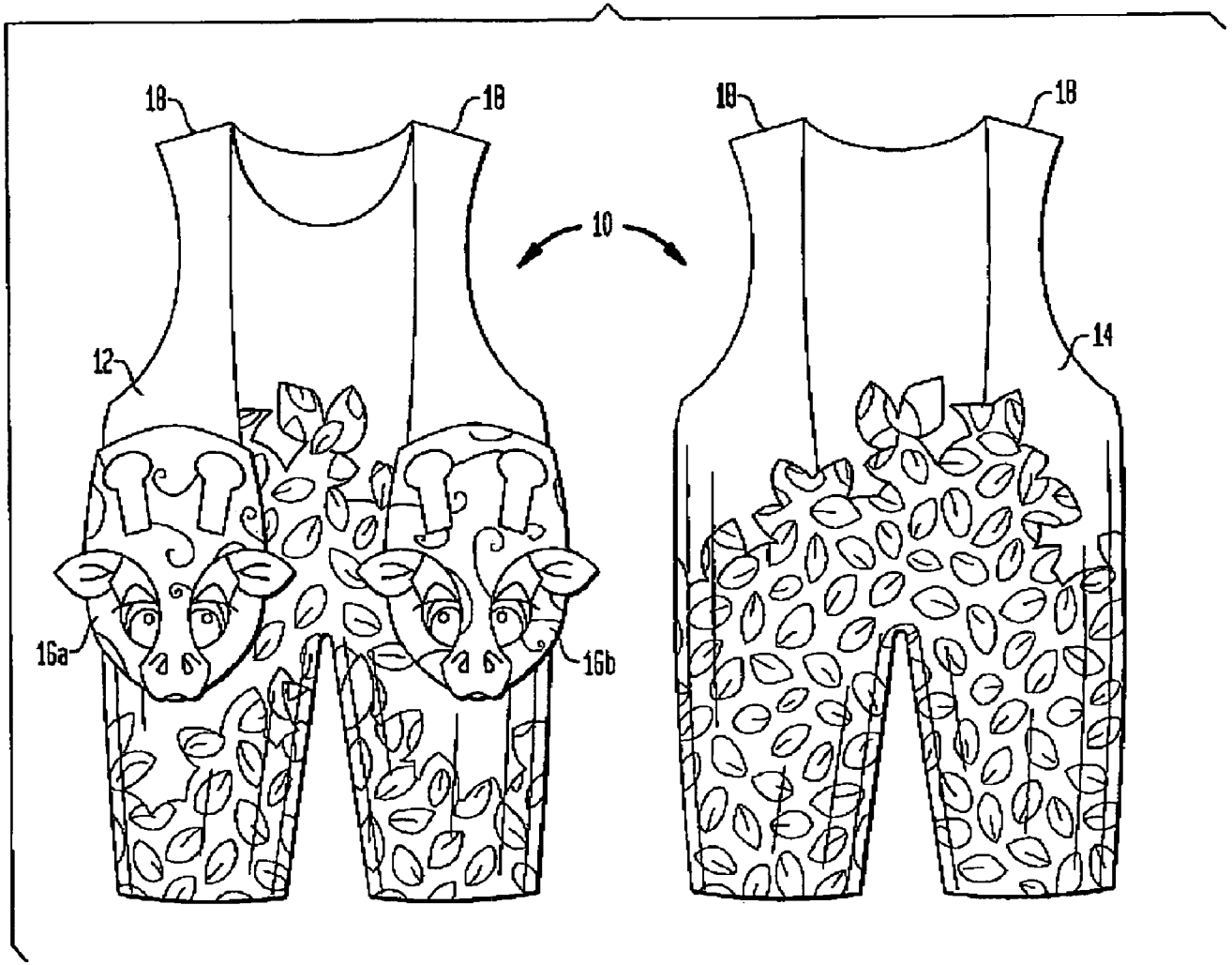
FIG. 1 illustrates one embodiment of the garment in accordance with the present invention showing frontal and back views of the garment and having a giraffe motif.
Figure 2:
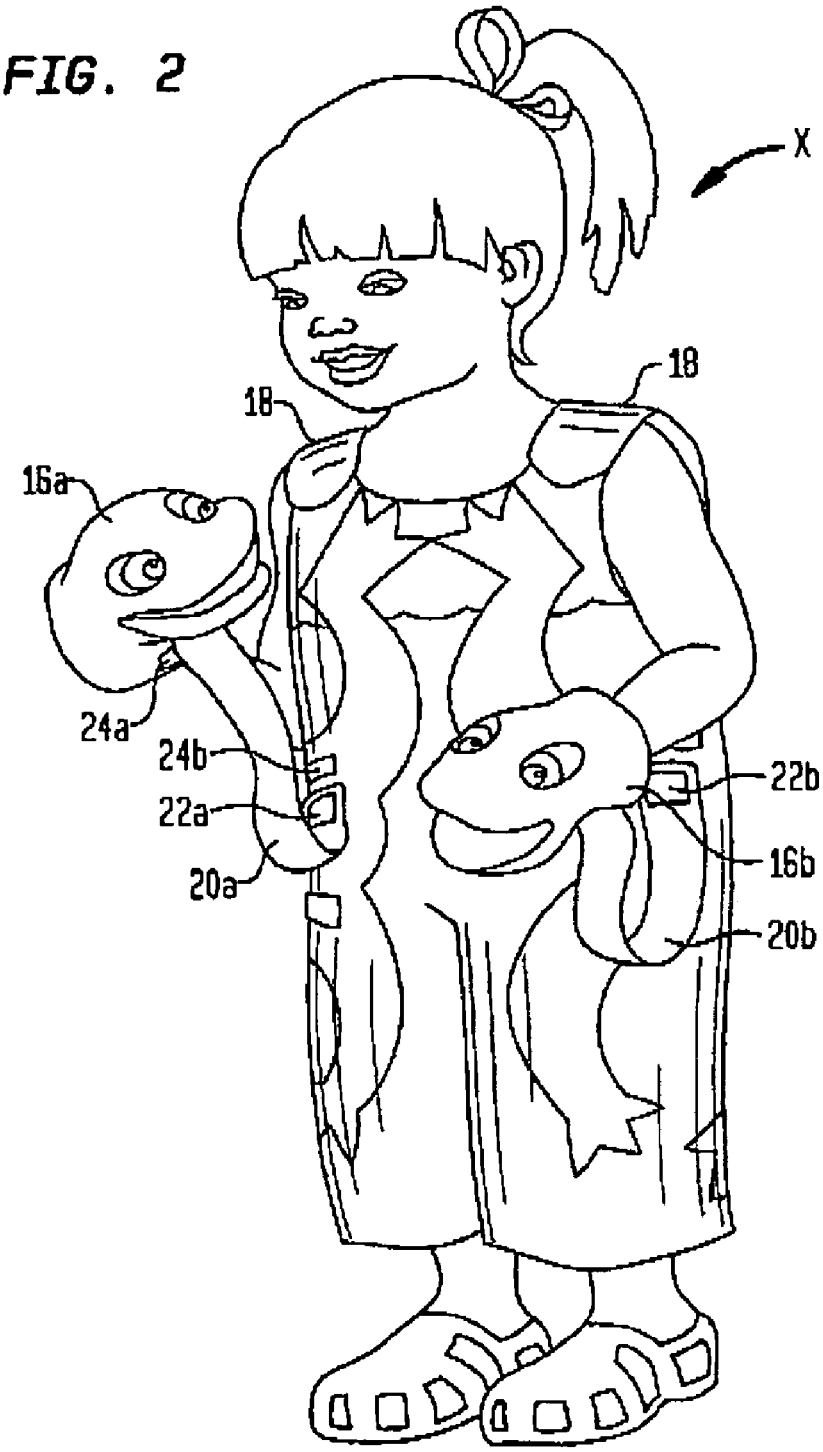
FIG. 2 illustrates one embodiment of the garment in accordance with the present invention showing the pockets detached from the garment and being worn on the hands of the garment wearer and having a frog motif.
Figure 3:
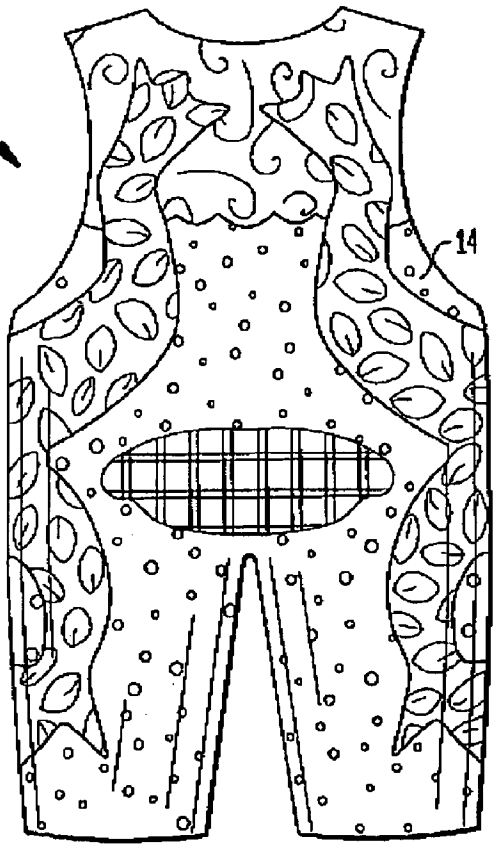
FIG. 3 illustrates the garment having a frog motif as shown I FIG. 2 but not being worn by the wearer.
Figure 4:
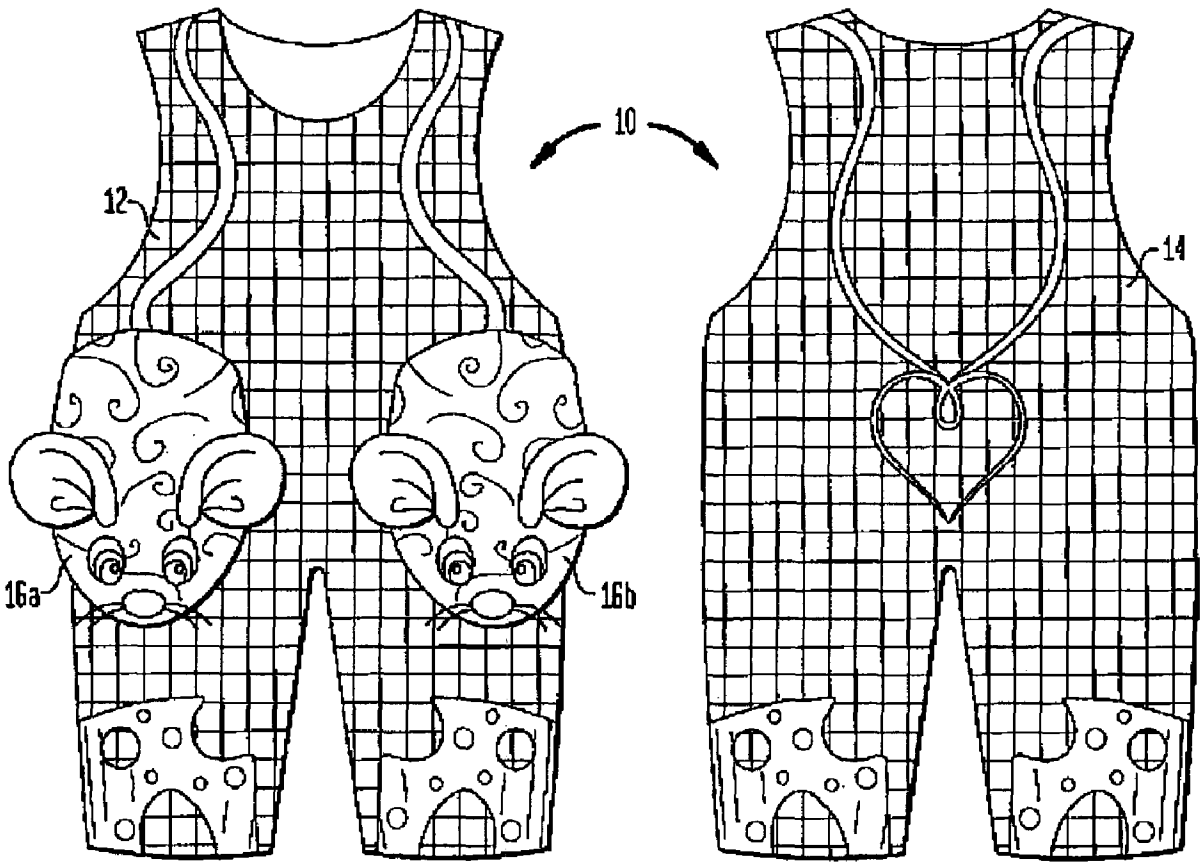
FIG. 4 illustrates another embodiment of the garment in accordance with the present invention and having a mouse motif.
Figure 5:
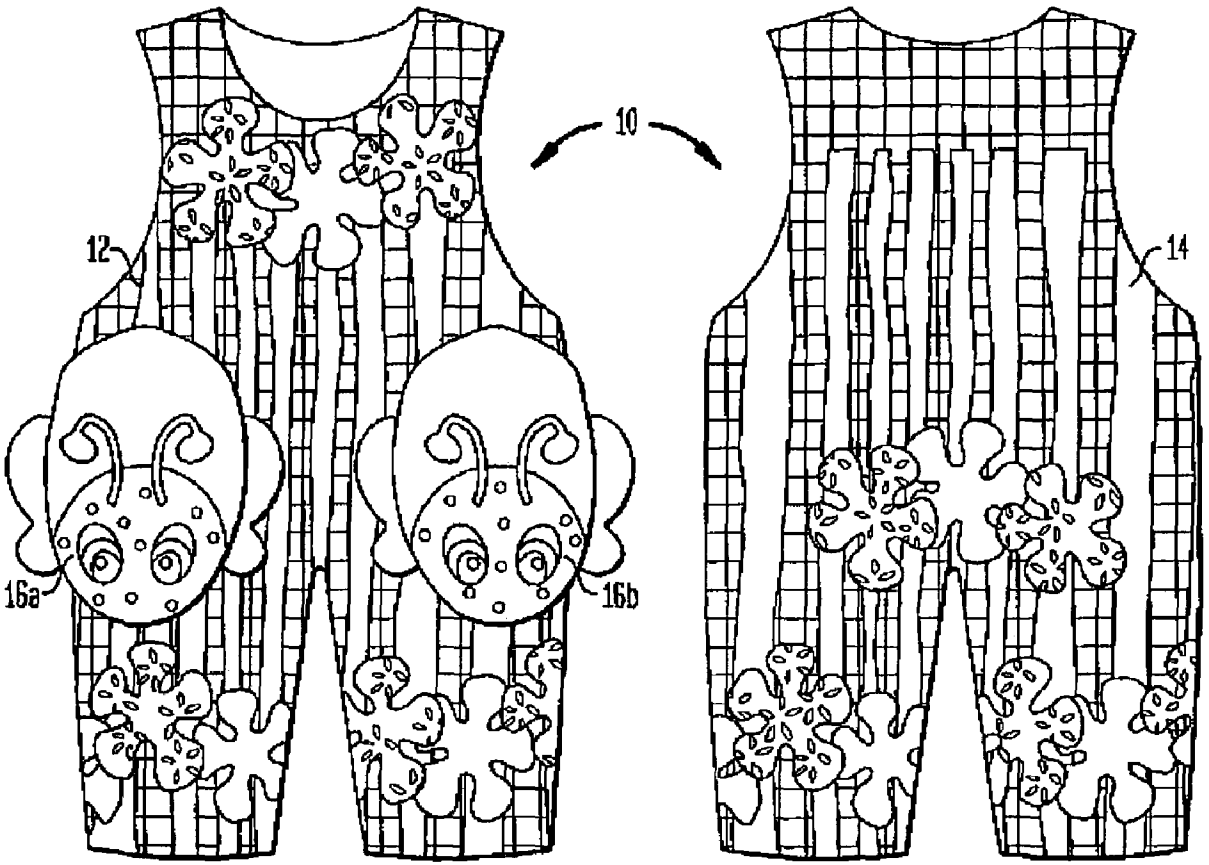
FIG. 5 illustrates another embodiment of the garment in accordance with the present invention and having a lady bug motif.

FIG. 1 shows one preferred embodiment of the invention comprising a garment 10 having a front surface 12 and a back surface 14 and having pockets 16*a*, 16*b* on the front surface 12. In the embodiment illustrated in FIG. 1, pockets 16*a*, 16*b* are shown to have a shape in form of a giraffe. The invention is not intended to be limited in this regard and pockets 16*a*. 16*b* may be in the form of a variety of different animals, characters and the like. In general, the shape or character of the pockets 16*a*, 16*b* will correlate with the overall coloring and motif of the garment 10. For example, in FIG. 1, pockets 16*a*, 16*b* are in the shape and color of giraffes, while garment 10 has the appearance of a jungle. In FIGS. 2 and 3, pockets 16 the shape of frogs, and garment 10 has a frog-like motif as shown. FIG. 4 illustrates garment 10 with pockets 16*a*, 16*b* having the appearance of mice. FIG. 5 illustrates garment 10 with pockets 16*a*, 16*b* having the appearance of lady bugs.

The pockets 16*a*, 16*b* are detachable from garment 10. Advantageously, pockets 16*a*, 16*b* are connected with garment 10 via hook-and-loop type fasteners, commonly known as Velcro®. FIG. 2 illustrates an embodiment of the present invention in which pockets 16*a*, 16*b* are removed from the garment and worn on the hands of the garment wearer (indicated by X). In this embodiment it is seen that pockets 16*a*, 16*b*, although detached from garment, 10, are nevertheless connected to garment 10 by an attachment element, such as via cords 20*a*, 20*b* which are connected to garment 10 at points 22*a*, 22*b*. Cords 20*a*, 20*b* prevent the loss of pockets 16*a*, 16*b* by the wearer. In alternative embodiments, points 22*a*, 22*b* may be detachable via hook-and-loop type fasteners, snaps, buttons, zippers and the like, so that garment 10 can be worn without pockets 16*a*, 16*b*. When the wearer's hands are inserted in pockets 16*a*, 16*b* and pockets 16*a*, 16*b* are removed from garment 10 by the wearer, pockets 16*a*, 16*b* can be used as hand puppets, which allow a child to entertain him or herself, or to play with other children wearing a similar garment and who have their own hand puppets. When the wearer no longer desires to play with the hand puppets (pockets 16*a*, 16*b*), they are reattached to garment 10. The hook-and-loop type fasteners are illustrated in FIG. 2 as 24*a*, 24*b*. As previously stated, the invention is not, however, limited to the use of hook-and-loop type fasteners to connect pockets 116*b* to garment 10, and other connection means are contemplated, such as but not limited to, buttons, snaps and zippers.

The present invention is not intended to be limited to the embodiment illustrated in FIG. 1 and other embodiments are contemplated. Garment 10 ma be a unitary garment that is pulled over the wearer's head, or it may have snaps, buttons, hook-and-loop type fasteners or tie strings in the shoulder areas (indicated as 18), or a zipper or tie strings on back surface 14. Additionally, garment 10 may be a halter-type garment having a front surface that may be tied around the wearer's back and/or neck.

Furthermore, although it is believed that garment 10 will be predominantly worn by children, the invention is not limited in this respect and adults may have occasion to where this type of garment as well.

I claim:

1. An article of children's clothing, comprising:

a garment, the garment being made of a cloth material, the garment having a front surface and a rear surface;

at least one pocket;

hook and loop type fasteners, the hook and loop type fasteners being attached to the at least one pocket and directly to the cloth material of the garment, the hook and loop type fasteners removably attaching and detaching the at least one pocket from the garment, the at least one pocket when attached to the garment is configured as a garment pocket used to retain objects placed therein and when detached from the garment is configured as a hand puppet; and a cord, the cord permanently affixing the at least one pocket to the garment so as to prevent the detached pocket from being lost.

2. The article of clothing according to claim 1, wherein the at least one pocket is positioned on the front surface so that the at least one pocket is easily accessible to a wearer's hand.

3. The article of clothing of claim 1, wherein the cord has a first end attached to the garment and a second end attached to the pocket.

4. The article of clothing of claim 1 wherein the back surface of the garment is attached to the front surface of the garment to form a unitary article of clothing.

5. The article of clothing of claim 4, wherein the front surface is attached to the back surface by a connecting element at a shoulder area of a wearer.

6. The article of clothing of claim 5, wherein the connecting element is selected from the group consisting of snaps, buttons, zippers, hook and loop type fasteners and tie strings.

7. The article of clothing of claim 1, wherein the hand puppet allows a wearer of the garment to insert a hand inside the hand puppet and manipulate the hand puppet.

8. An article of children's clothing, comprising:

a garment, the garment being made of a cloth material, the garment having a front surface and a rear surface;

at least one pocket;

a first attachment element the first attachment element being attached to the at least one pocket and directly to the cloth material of the garment, the first attachment element removably attaching and detaching the at least one pocket from the garment; and a second attachment element, the second attachment element fixedly attaching the at least one pocket to the garment, the second attachment element being a cord having a first end attached to the garment and a second end attached to the pocket, whereby the at least one pocket when attached to the garment is configured as a garment pocket used to retain objects placed therein and when detached from the garment is configured as a hand puppet.

9. The article of clothing according to claim 8, wherein the at least one pocket is positioned on the front surface so that the at least one pocket is easily accessible to a wearer's hand.

10. The article of clothing of claim 8, wherein the first attachment element includes a hook and loop fastener.

11. The article of clothing of claim 8, wherein the first attachment element is selected from a group consisting of snaps, buttons and zippers.

12. The article of clothing of claim 8, wherein the first end is fixedly attached to the garment.

13. The article of clothing of claim 8, wherein the first end is removably attached to the garment.

14. The article of clothing of claim 8, wherein the back surface of the garment is attached to the front surface of the garment to form a unitary article of clothing.

15. The article of clothing of claim 14, wherein the front surface is attached to the back surface by a connecting element at a shoulder area of a wearer.

16. The article of clothing of claim 15, wherein the connecting element is selected from the group consisting of snaps, buttons, zippers, hook and loop type fasteners and tie strings.

17. The article of clothing of claim 8, wherein the hand puppet allows a wearer of the garment to insert a hand inside the hand puppet and manipulate the hand puppet.

* * * * *